US008547006B1

(12) United States Patent
Ives et al.

(10) Patent No.: US 8,547,006 B1
(45) Date of Patent: Oct. 1, 2013

(54) ELECTRON GUN FOR A MULTIPLE BEAM KLYSTRON WITH MAGNETIC COMPRESSION OF THE ELECTRON BEAMS

(75) Inventors: R. Lawrence Ives, San Mateo, CA (US); Hien T. Tran, Cary, NC (US); Thuc Bui, Mountain View, CA (US); Adam Attarian, Raleigh, NC (US); William Tallis, Cary, NC (US); John David, Wooster, OH (US); Virginia Forstall, Fairfax, VA (US); Cynthia Andujar, Cary, NC (US); Noah T. Blach, Chapel Hill, NC (US); David B. Brown, Raleigh, NC (US); Sean E. Gadson, Columbia, SC (US); Erin M. Kiley, Loudon, NH (US); Michael Read, Plainfield, VT (US)

(73) Assignee: Calabazas Creek Research, Inc., San Mateo, CA (US)

( * ) Notice: Subject to any disclaimer, the term of this patent is extended or adjusted under 35 U.S.C. 154(b) by 156 days.

(21) Appl. No.: 12/705,160

(22) Filed: Feb. 12, 2010

(51) Int. Cl.
*H01J 29/02* (2006.01)

(52) U.S. Cl.
USPC ..... 313/414; 313/409; 313/383; 313/389; 313/446

(58) Field of Classification Search
USPC ..... 313/412–414, 409, 383, 389, 390, 313/441–460, 364–477 HC; 220/2.1 A, 2.2, 220/2.1 R, 2.3 A, 2.3 R
See application file for complete search history.

(56) References Cited

U.S. PATENT DOCUMENTS

| | | | | |
|---|---|---|---|---|
| 4,508,992 | A | 4/1985 | Bohlen et al. | |
| 4,672,458 | A * | 6/1987 | McKechnie | 348/749 |
| 4,733,131 | A | 3/1988 | Tran et al. | |
| 5,032,763 | A | 7/1991 | Mourier | |
| 5,838,107 | A | 11/1998 | Beunas et al. | |
| 5,932,972 | A | 8/1999 | Symons et al. | |
| 6,147,447 | A | 11/2000 | Beunas et al. | |
| 6,304,034 | B1 * | 10/2001 | Hosokawa et al. | 315/9 |
| 6,486,605 | B1 | 11/2002 | Beunas et al. | |
| 6,768,265 | B1 | 7/2004 | Ives et al. | |
| 6,847,168 | B1 * | 1/2005 | Ives et al. | 315/5.14 |
| 7,005,789 | B2 | 2/2006 | Cattelino et al. | |
| 7,116,051 | B2 | 10/2006 | Vancil et al. | |
| 7,385,354 | B2 | 6/2008 | Miyake | |
| 7,446,478 | B2 | 11/2008 | Syratchev | |
| 2010/0045160 | A1 * | 2/2010 | Dayton et al. | 313/414 |

* cited by examiner

*Primary Examiner* — Anh Mai
*Assistant Examiner* — Fatima Farokhrooz
(74) *Attorney, Agent, or Firm* — File-EE-Patents.com; Jay A. Chesavage

(57) ABSTRACT

A multi-beam electron gun provides a plurality N of cathode assemblies comprising a cathode, anode, and focus electrode, each cathode assembly having a local cathode axis and also a central cathode point defined by the intersection of the local cathode axis with the emitting surface of the cathode. Each cathode is arranged with its central point positioned in a plane orthogonal to a device central axis, with each cathode central point an equal distance from the device axis and with an included angle of 360/N between each cathode central point. The local axis of each cathode has a cathode divergence angle with respect to the central axis which is set such that the diverging magnetic field from a solenoidal coil is less than 5 degrees with respect to the projection of the local cathode axis onto a cathode reference plane formed by the device axis and the central cathode point, and the local axis of each cathode is also set such that the angle formed between the cathode reference plane and the local cathode axis results in minimum spiraling in the path of the electron beams in a homogenous magnetic field region of the solenoidal field generator.

19 Claims, 6 Drawing Sheets

Brillouin Focused Pierce Electron Gun

Confined Flow Pierce Electron Gun

Cathode Geometry
Side View (YZ plane through cathode central point)

Cathode Geometry
Side View (XZ plane)

Perspective View, Multi-beam Electron Gun

Cut-away and cross section view of a multi-beam klystron

Multi-beam klystron (perspective view)

ELECTRON GUN FOR A MULTIPLE BEAM KLYSTRON WITH MAGNETIC COMPRESSION OF THE ELECTRON BEAMS

The present invention was developed under the United States Department of Energy grant DE-FG02-06ER86267. The government has certain rights in this invention.

FIELD OF THE INVENTION

The present invention relates to linear beam electron devices, and more particularly, to an electron gun that provides multiple convergent electron beamlets suitable for use in a multiple beam klystron using confined flow magnetic focusing.

BACKGROUND OF THE INVENTION

Linear beam electron devices are used in sophisticated communication and radar systems that require amplification of a radio frequency (RF) or microwave electromagnetic signal. A conventional klystron is an example of a linear beam electron device used as a microwave amplifier. In a klystron, an electron beam is formed by an electron gun which has a thermionic cathode with a negative pulsed or direct current (DC) voltage which thermionically emits electrons that are attracted to a grounded anode through a focusing electrode which shapes the electron field. The comparatively positive voltage of the anode accelerates the thermionically emitted electrons, with the electron beam confined to travel in a beam tunnel through the application of an external axial magnetic field. The electrons originating at the cathode of the electron gun propagate through a drift tube comprising an equipotential surface which encompasses the electron beam tunnel, thereby eliminating the accelerating force of the applied voltage. The drift tube includes a number of gaps that define resonant cavities of the klystron. The electron beam is velocity modulated by an RF input signal introduced into one of the resonant cavities. The velocity modulation of the electron beam results in electron bunching due to electrons that have had their velocity increased, gradually overtaking those that have been slowed. The traveling electron bunches represent an RF current in the electron beam, and this RF current induces electromagnetic energy into a subsequent one of the resonant cavities positioned along the beam tunnel. The electromagnetic energy may then be extracted from a subsequent resonant cavity as an amplified RF output signal.

Since the invention of the klystron, it has been recognized that a klystron having multiple electron beams, each beam travelling in a separate drift tube, would have certain advantages over a klystron having a single electron beam in a single drift tube. There are three principle advantages of a multiple-beam approach over a single beam approach. The first advantage over a single beam is the improved strength and uniformity of the electric field across the resonant cavities formed by the gaps at the ends of the multiple drift tube bundles, which are aligned about the resonant cavities, compared to the fields across the resonant cavities formed by a gap of a single drift tube. The second advantage is that electrons in one of the drift tubes are isolated from electrons in the other drift tubes. This isolation results in lower debunching, or space charge forces, since the self-repelling space charge force of electrons in the beam is increased with the greater electron beam density required by higher power devices. The reduced space charge effect in a multiple beam klystron results in a higher current, lower voltage device which typically results in a higher efficiency and higher power device compared to a conventional single beam klystron having a low current electron beam operating at a much higher voltage. The third advantage is that a multiple beam klystron can achieve much more bandwidth than a conventional klystron because the fringing capacitance and electric field around the bundle of drift tubes at each gap is a smaller fraction of the useful electric field in the gap which interacts with the electrons. The reduction factor of this capacitance is approximately equal to the number of parallel beams.

RELATED ART

A device described by Symons U.S. Pat. No. [5,932,972] provides for a convergent multiple beam gun having a single cathode, a first plurality of conductive grids, a second plurality of drift tubes further containing resonant gaps, and an anode. The first plurality of conductive grids are spaced between the cathode and drift tubes, and contain apertures in locations such that electron beamlets are formed and defined by electrons travelling from the cathode, through the apertures in each of the grids, and into the drift tubes. Each of the grids has these apertures in substantial registration with each other and with respective openings of the plurality of drift tubes.

Symons relies on a plurality of grids to shape the electric potentials to focus the individual beamlets into the respective drift tunnels. In one embodiment of the invention, four separate grids are required to provide the necessary electric field configuration. Ceramic insulators providing a portion of the vacuum envelope of the device must electrically isolate each grid. In addition, a separate voltage is required for each grid.

The device described by Symons does not provide for confined flow focusing, as it can be seen that no magnetic focusing field is applied, and beam focusing is performed entirely by electrostatic potentials applied to the many grids. Consequently, the beam will not be fully confined in the presence of space charge bunching, limiting the average and peak power capability of the device. No mechanism is described for compressing the multiple beams toward the device axis.

As the RF frequency increases, the available space for multiple beams through a fundamental mode cavity decreases in proportion to the increase in frequency. Consequently, the number of beams that can propagate through a fundamental mode cavity becomes limited by mechanical and thermal constraints. An alternative is to use a ring resonator circuit as described by Bohlen in U.S. Pat. No. 4,508,992. With a ring resonator circuit, the number of beamlets is not strictly limited by frequency considerations. Bohlen describes a traveling wave tube having an annular cathode, an annular ring resonator for the introduction of RF energy, an annular ring resonator for the removal of RF energy, and an annular cathode, all of which are operating in the presence of a magnetic field. This structure enables reduced current densities, confined flow, and the application and collection of RF energy over a large physical area. The disadvantage of this structure is that the large physical area creates additional capacitance, which implies a narrow band of operation compared to a device having physically smaller RF structures. Additionally, the enlarged resonant cavities of Bohlen can also support oscillation of parasitic modes that can disrupt proper operation of the device.

Ives (U.S. Pat. Nos. 6,847,168 and 6,768,265) describes magnetic structures for convergent electron beams with confined flow focusing. The structures modify the magnetic field such that they are symmetric about the individual cathode centers.

The prior art for multiple beam electron guns describes electron gun structures for which the electron beams are parallel to each other and the device axis throughout the device, whereby the distance from the central axis of the device to each cathode center is the same as the distance from the central axis to the center of the electron beam. The parallel electron trajectory for each cathode throughout the device limits the radial beam separation of the parallel beams to the radius of a particular cathode. In the prior art, this is done because no alternative electron beam design has been discovered. None of the prior art devices teaches compression of the multiple beams toward the device axis and resulting in parallel beams in the RF circuit axial extent of the device, such that the distance from the central axis to the electron beam in the RF cavity axial extent is significantly less than the distance from the cathode center to the device central axis at the electron gun.

SUMMARY OF THE INVENTION

In the present invention, the electrons of a plurality of electron gun assemblies are compressed about the local axis of each electron gun cathode, and the ensemble of beams converge and are compressed about the device central axis. When electrons are emitted from a cathode surface in a magnetic field, they incur canonical angular momentum that must be conserved. Any change in the magnetic field will impose transverse velocity on the individual electrons perpendicular to the axis upon which they are converging. For doubly convergent electron beams, there will be two axes toward which the electrons converge. The first axis is the local axis along which the individual beamlets are propagating, and the second axis is the device axis toward which all the beams are converging. Convergence toward the local axis results in rotational velocity necessary to balance space charge in the beam, which is necessary for beam propagation. Convergence of the electron beams toward the device axis induces rotational velocity about the device axis. Unless the rotational velocity is eliminated in the circuit region, it becomes impractical and expensive to fabricate an RF circuit for energy extraction because the spiraling of the beams through the RF circuit results in undesirable enlargement of the drift tubes and poor coupling to the RF cavities. Alternatively, the fabrication of a spiraling beam tunnel through the RF circuit axial extent of uniform magnetic compressed magnetic field is only practical in short sections, such as the RF circuit axial extent, where computer numerical control (CNC) machining capability exists over reasonable distances. The inefficiency of spiraling electron beams is caused by reduced coupling of electron beam energy into the RF cavities, which extract energy through axial bunching and debunching of the spiraling beam, which has a component of transverse electron motion. Energy which is present in electrons in transverse motion (radial or azimuthal) reduces the accessible energy in the beam for RF power generation. Additionally, bunching of the modulated electron beam couples with the density variations of the spiraling motion of the electron beam and contributes to beam spreading and break-up. A primary object of the present invention is to provide a configuration of magnetic field and corrective spatial orientation of the local axis of each electron gun cathode to eliminate this spiraling and provide electron beams that propagate parallel to the device axis through the RF circuit axial extent and region.

The present invention provides a multi-beam electron gun for a device having a solenoidal magnetic field which surrounds a central (Z) axis, where the magnetic field is compressed over an RF circuit axial extent, and the magnetic field diverges (decompresses) on either side of the RF circuit axial extent. A plurality N of optionally circularly symmetric cathodes are positioned in a cathode plane perpendicular to the central Z axis in a region where the magnetic field diverges and at a uniform radial separation distance from the Z axis to each cathode, and with the cathodes separated from each other by a uniform angular separation 360/N about the Z axis. In one embodiment of the invention, each particular cathode is circularly symmetric and has a local cathode axis and also a center point on the cathode emission surface which intersects the local cathode axis. Alternatively, the cathode may have a defined local central axis and a center point where the cathode is not symmetric about its local central axis. The cathode reference plane is formed by the Z axis and the center point of the particular cathode. The diverging magnetic flux lines pass through the cathode center point at a magnetic flux convergence angle with respect to the Z axis, and the local cathode axis is established in a first step such that the projection of the local cathode axis onto the cathode reference plane forms a cathode convergence angle with respect to the Z axis which cathode convergence angle is typically within 5 degrees of the magnetic field convergence angle. In addition to the convergence angle thus described, a second cathode azimuthal angle is defined as the angle between the local cathode axis and the cathode reference plane for that cathode. In a second step, the cathode azimuthal angle is selected such that the spiraling trajectory of each electron leaving the cathode is balanced by the increased confining magnetic field, and the electron beam tunnel forms a slow helical trajectory before settling into a linear electron beam over the RF circuit axial extent, which contains drift tubes, resonant cavities, and other RF structures. By careful orientation of the cathode local axis in the reference plane using the cathode convergence angle and selection of the cathode azimuthal angle, and iterating on the selection of the cathode convergence angle and cathode azimuthal angle to minimize beam spiraling in the RF axial extent, a plurality N of linear and parallel electron beams can be provided which are suitable for use in a multi-beam electron device, and which operates on the particular intrinsic magnetic field generated by the solenoidal field generator, such that no external magnetic field correction is required. The parallel and linear electron beams are generated by the selection of electron launch angle at the local cathode using the orientation in space of a first cathode local axis as described, and the cathode local axis angles of the other cathodes are selected to match the first cathode local axis angle.

The present multiple beam electron gun may be used to generate a source of multiple electron beams, each beam parallel to the axis and to other beams in the RF circuit axial extent. In an embodiment as an electron gun for an RF device the multiple electron beams converge and pass through a set of electron beam tunnels which have drift tubes and resonant cavities formed in the beam tunnel. The present invention may be used for any device which would benefit from convergent multiple electron beams, such as high frequency, high power RF generators, including traveling wave tubes, multiple beam klystrons or inductive output tubes (IOT). The associated RF circuit for use with the electron gun of the present invention may have a plurality of parallel drift tubes over the RF circuit axial extent for the transport of multiple convergent beamlets in a rectilinear flow. Each drift tube carries an electron beam formed by an individual electron gun, and a plurality of these electron guns is arranged in a circular ring, with each electron gun providing a beam for use by an associated drift tube. Each electron gun has a cathode, an electrostatic focusing electrode and anode structure. The path of the confined flow of electrons from each electron gun through the drift tubes of the device forms a beam tunnel, and each separate gun has its own separate beam tunnel. In addition to convergence of the individual electron beams about their local axis, the plurality of electron beams converge toward the device axis in the region between the cathode and the RF circuit and propagate through the RF circuit parallel to the device axis. This requires that the drift tunnels between the cathode-anode region and the circuit also converge toward the device axis.

The RF circuit of the multi-beam device includes gaps between drift tubes which form resonant cavities for the introduction and removal of RF power. The RF power introduced into an input port of the device operates on each individual beamlet traveling through each individual beam tunnel, and RF power extracted at the output port is summed by the RF output structure. In the context of the present multi-beam electron gun, a high power composite electron beam is formed which comprises the contribution of each individual beamlet, so the output power of the device is limited only by the number of beamlets that are contributing to the RF output port.

In one embodiment of the invention, an electron gun assembly for the generation of N electron beams arranged circularly about a device axis is generated by a plurality N of cathodes, each cathode having a local cathode axis and a cathode point defined by the intersection of the local cathode axis with the front emitting surface of the cathode. The plurality of cathodes are arranged with each cathode point in a plane perpendicular to the device axis, and the cathode points spaced substantially 360/N degrees apart from each other with respect to the device axis.

In one embodiment of the invention, the beam tunnels for each electron beam include drift tubes having a first resonant cavity defined by a first gap provided in the plurality of drift tubes, and a final resonant cavity defined by a subsequent gap provided in the plurality of drift tubes. An electromagnetic signal is coupled into an RF input port to the first resonant cavity, which velocity modulates the beamlets traveling in the plurality of drift tubes. The velocity modulated beamlets then induce an electromagnetic signal into the final resonant cavity, which may then be extracted from the device RF output port as a high power microwave signal. Other resonant gaps may also be applied between the first and final resonant gap. A collector is disposed at second respective ends of the plurality of drift tubes, which recovers the remaining energy of the beamlets after passing across the first and second gaps.

A magnetic field oriented coaxially to the beam tunnel is furnished to provide confined flow of the electron beam. In prior art devices, the magnetic field was shielded from penetration into the cathode-anode region. These devices were referred to as Brillouin focused and were less confined by the magnetic field. Other prior art devices allowed penetration of the magnetic field into the cathode-anode region and required iron structures to modify the field configuration to be symmetric with respect to the individual cathodes.

The present device requires no iron structures in the cathode region to shape the magnetic field. A pole piece is required, as with standard single beam devices, to control the amount of field penetrating into the cathode-anode region. In the present device, the field remains cylindrically symmetric with the device axis, but symmetry about the individual cathodes or electron beams is not required.

OBJECTS OF THE INVENTION

A first object of the invention is a multiple beam electron gun having a Z axis operative in a magnetic field having a uniform magnetic flux region and a diverging magnetic flux region, the multiple beam electron gun generating a plurality of electron beams, each electron beam parallel to the Z axis over the uniform flux region of a Z axis extent, each electron gun having a cathode with a local cathode axis and a center point located at the intersection of the cathode local axis and the emitting surface of the cathode, each local cathode axis having a reference cathode plane defined by the Z axis and the central cathode point, the local cathode axis set to a first parametric angle known as cathode divergence angle $\Theta$ which is established by the angle of the diverging magnetic flux at the point where the diverging magnetic flux passes through the cathode central point, a second parametric angle known as a cathode azimuthal angle $\psi$ which is the angle between the local cathode axis and the cathode reference plane, where the cathode azimuthal angle provides an out-of-center launch of the electron beam into the diverging magnetic field, where the first parametric angle and second parametric angle selections result in the cancellation or minimization of the beam spiraling in the RF axial extent, thereby providing substantially parallel electron beams over the uniform flux region of the Z axis.

A second object of the invention is a multiple electron gun having a plurality N of electron guns, each having a cathode, each cathode having a cathode local axis, where each electron gun generates an electron beam which converges under the influence of an axial magnetic field, and the cathode local axis is set such that the electron beams converge such that the electron beams are parallel to a central axis over an RF circuit axial extent where the axial magnetic field is uniform, and the distance from each cathode to the central axis is larger than the distance from an associated electron beam center to the central axis in the RF circuit axial extent.

A third object of the invention is a method for selection of a cathode first parametric angle and a cathode second parametric angle in a multi-beam electron gun having a magnetic field generator located about a Z axis and generating a substantially uniform magnetic field over an RF circuit axial extent, the magnetic field diverging outside the RF circuit axial extent, the multi-beam electron gun having a plurality N of electron guns located about the Z axis, each electron gun having a cathode with an emission surface and a local cathode axis, the cathode having a center point at the intersection of the emission surface and the local cathode axis, the first parametric angle formed by the angle between the Z axis and the line formed by the projection of the cathode axis onto a cathode reference plane formed by the Z axis and the cathode center point, the second parametric angle formed by the angle between the cathode reference plane and the local cathode axis, the first parametric angle and the second parametric angle controlling the spiraling of a resultant electron beam, the spiraling having an associated spiraling metric;

the method having:

a first step of selecting a plurality of first parametric angles which is within five degrees of the magnetic field divergence at the cathode center point;

a second step of selecting a plurality of the second parametric angles and evaluating each the combination of the first parametric angle and the second parametric angle for the spiraling metric;

a third step of selecting a minimum spiraling metric and associated the first parametric angle and the second parametric angle;

a fourth step of using the first parametric angle and second parametric angle associated with the minimum spiraling metric for each the cathode of the N electron guns.

DETAILED DESCRIPTION OF THE INVENTION

Prior art multiple beam klystrons have been developed where the electron beams emitted from multiple cathodes propagate parallel to the device axis at the same radius from the device central axis as the cathodes. There are two types of multiple beam guns currently available for these devices: non-convergent and convergent.

In the non-convergent devices, electron beam focusing is provided by immersing the electron gun and drift tubes in a uniform magnetic field which guides the electrons along the magnetic flux lines to the drift tubes. In a non-convergent electron gun, the diameter of the emitting surface is the same as the electron beam that propagates through the RF device. The non-convergent electron beams of this class of device have limited current density, which prevent them from developing more power at higher frequencies. The amount of current that can be emitted from the cathode is dependent on the size of the emitting surface and the maximum electron emission density that can be provided by the surface for reasonable cathode lifetimes. Maximum electron emission densities from typical cathodes operating in the space charge limited regime are on the order of 6 amps/cm^2.

In a convergent electron gun, the cathode diameter exceeds the diameter of the final electron beam, which means that more current can be provided. The current gain is proportional to the area compression factor of the gun, which is the ratio of the cathode area to the cross sectional area of the final electron beam. Typical compression factors are 5-20.

Confined flow convergent electron guns are common for most single beam linear devices and have recently been developed for multiple beam devices. Structures for focusing these confined flow convergent beams are described in U.S. Pat. No. 6,847,168 by Ives.

Figure 1:
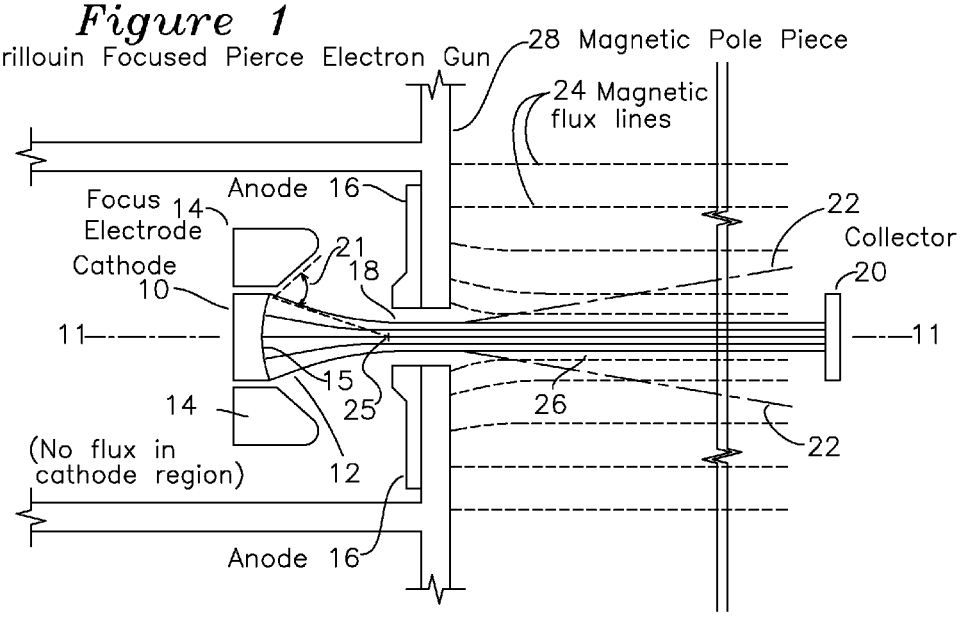
FIG. 1 shows a Buillouin focused electron gun in a single beam configuration.

Electron beams used for linear RF devices typically employ one of two types of magnetic focusing, which act in addition to the initial electrostatic focusing of a Pierce electron gun, whereby a stream of emitted electrons is initially focused to a region of minimum beam diameter. The first type of magnetic focusing is Brillouin focusing, where the magnitude of the magnetic field in the RF circuit section of the device precisely balances the space charge repulsion forces within the static beam. An embodiment of such a single beam electron gun is shown in FIG. 1. Electrostatic focusing is used to guide the electron beam from the cathode emitting surface to a point within the anode beam tunnel. A minimum diameter is achieved, and if a counteracting magnetic field were not applied, the beam would begin to diverge due to space charge forces. In Brillouin magnetically focused devices such as shown in FIG. 1, an axial magnetic field 24 is imposed at the location of the minimum diameter of the electron beam 18 that balances the space charge forces which would otherwise cause the beam to diverge 22 and facilitates transport of the beam through the RF structures of the device. Magnetic flux 24 is excluded by magnetic pole piece 28 which surrounds the cathode 10, focus electrode 14, and anode 16, which are circularly symmetric about axis 11. After the shaped electron beam passes through the RF structures of the device (not shown) the beam dissipates at collector 20.

The disadvantage of Brillouin focused devices of FIG. 1 is that the balance between the space charge force tending to expand the beam (shown as divergence 22) and the magnetic force tending to confine the beam 18 (shown maintaining profile 26 in the RF circuit axial extent) is no longer equal when electrostatic bunching of electrons occurs in the RF section, as is required to transform electron beam power into RF power. Consequently, the electron beam will expand in regions of high electron density, and the expansion lowers the space charge which eventually becomes much less than can be balanced by the magnetic field. Consequently, the beam begins to radially expand and contract along the Z axis without a reduction in the rippling. As a result, the beam has a rippled profile as it travels down the Z axis as the electrons oscillate between high electron beam compression and low beam compression. This ripple in the diameter of the cross section beam profile results in a poor quality electron beam that either hits the beam tunnel walls or results in reduced RF performance. Interactions between the beam and tunnel can result in destruction of the device unless the power deposited is limited. Therefore, Brillouin focused devices are limited in the average RF power that can be generated.

Figure 2:
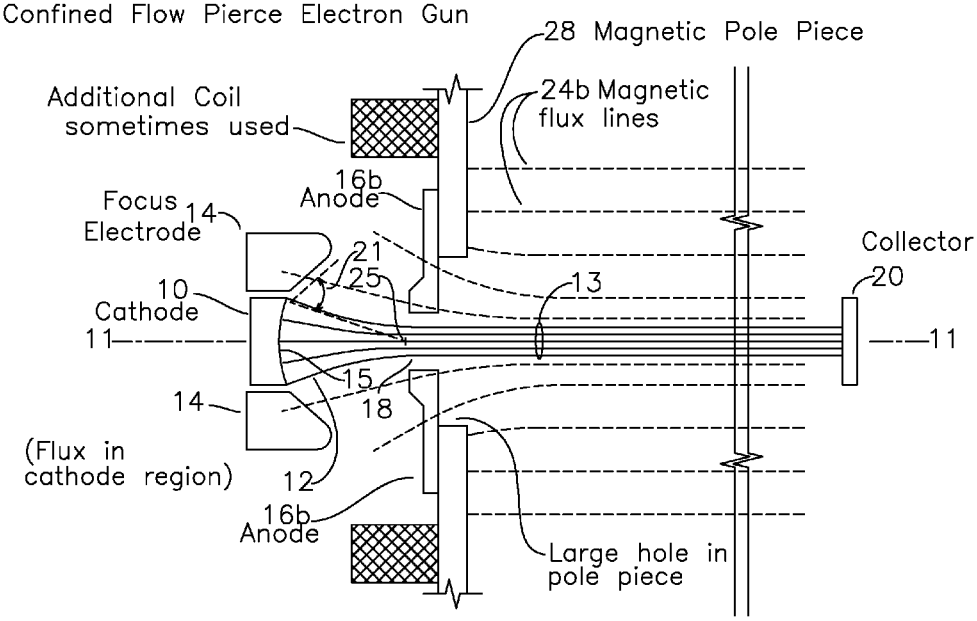
FIG. 2 shows a confined flow electron gun in a single beam configuration.

The alternative is to use convergent, confined flow focusing, as shown in the single electron gun device of FIG. 2. With confined flow focusing, the magnetic field 24 expands beyond the RF circuit axial extent to the cathode regions including cathode 10, focus electrode 14, and anode 16*b*. A combination of magnetic flux 24*b* from an external solenoidal magnetic field generator (not shown) and electrostatic focusing potentials applied to focus electrode 14 and anode 16*b* guide the electron beam from the cathode 10 into the beam tunnel (not shown) which surrounds electron beam 13 in the RF circuit axial extent of the device. With confined flow focusing, the magnetic field 24*b* can be higher than is required for balancing the space charge forces in the static beam, resulting in parallel, confined flow and a higher quality electron beam. In typical devices, the confined flow magnetic field 24*b* is 2-3 times the Brillouin value 24 used in FIG. 1. With confined flow focusing, the electron beam will be contained as it traverses the beam tunnel, even in the presence of electron bunching as used to generate RF power. Consequently, confined flow focused devices are capable of high average power operation compared to Brillouin devices.

Multiple beam electron guns may be provided in parallel beam tunnels through shared RF structures to increase the RF power capability of the device, such as by using a plurality of individual confined flow electron beams. Because of the increased radius of an RF cavity required to support the multiple beams which pass through the cavities, the RF cavities are capable of supporting higher mode EM waves than smaller fundamental mode RF cavities that could be used with a single beam device. Because of the tendency for a larger RF cavity to support higher order modes than the fundamental mode, it is desired to use multiple electron beams in combination with the smallest possible RF circuits such that the RF circuit operates using fundamental mode cavities. Fundamental mode cavities have the advantage of not oscillating in spurious higher order modes that disrupt the operation and reduce the power capability of the device. However, this requirement of excluding higher modes limits the diameter of the RF cavities. Consequently, a limit is reached on the radial distance of the multiple electron beams from the device axis. For an electron gun where the beam radii is the same as the cathode radii, a limit is reached on the size of the cathodes or the number of cathodes that can be used within the diameter allowed for fundamental mode operation.

A solution is to locate the cathodes at a greater radial distance from the device axis and compress the multiple beams toward the device axis so they propagate parallel the axis and within the allowed radius of the fundamental mode circuit. The devices of the prior art use either large cathodes located radially separated from the device axis in combination with a ring resonator RF structure having overmoded cavities supporting higher resonant modes than the fundamental mode, or use small cathodes located near the device axis with smaller fundamental mode cavities, resulting in much lower power operation to preserve cathode life. Alternatively, by trading off device cathode life for higher power operation, it is possible to use the small cathode geometry previously described with fundamental mode cavities, which is also undesirable. It is desired to provide a multiple electron beam gun which has a minimum overall transverse beam extent, and for which each of the electron beams provides a uniform beam which travels substantially parallel to a main device axis. It is desired that the multiple beams travel substantially parallel to each other, each beam equidistant from a central axis and with a transverse angular separation of 360/N degrees with respect to the central axis, where N is the number of electron beams.

From principles of electromagnetic theory, when an electron is injected in a magnetic field, such as from a thermionic cathode, the electron inherits an initial canonical angular momentum in the form of an azimuthal velocity which must be conserved as the magnetic field changes. If the magnetic field through which the electron moves is uniform, then the azimuthal velocity of the electron is unchanged. However, if the magnetic field density increases, the azimuthal velocity of the electron must also change to conserve angular momentum. For example, in a single electron beam gun injecting on-axis, an electron emitted into a magnetic field which compresses and is symmetric about an axis, such as a prior art confined flow electron gun, the angular momentum is conserved as the field compresses, which changes the electron azimuthal velocity about the axis. In a cathode located off the central axis and which injects electrodes, the compression of the magnetic field causes the entire electron beam to develop an undesired spiraling as it propagates through the region of uniform magnetic field where the RF structures are usually located. This spiraling is the primary reason that the prior art multiple-beam electron guns have cathode arrangements which are parallel to the device axis. By contrast, in the present invention, an initial angular momentum is created by the orientation of the cathode in the compression region of the magnetic field, which causes an azimuthal velocity which results in spiraling of the electron beam in the region of magnetic field compression, such that as the magnetic field compresses, the azimuthal angular velocity reduces to substantially zero in the uniform magnetic field region of the RF structures, where the beam travels through the beam tunnel and RF structures without spiraling. This allows for a beam-to-beam separation which is significantly less than the associated cathode-to-cathode separation.

Figure 3A:
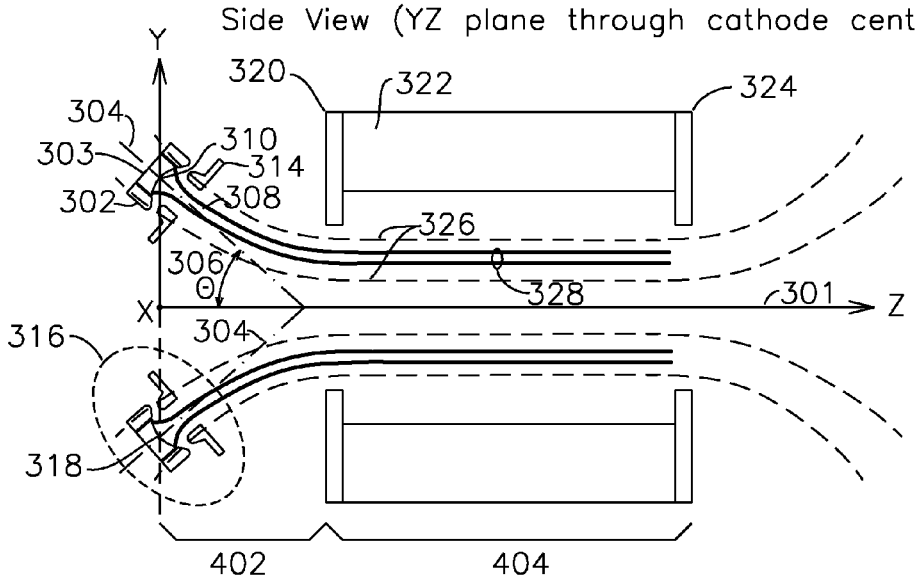
FIG. 3A shows a cross section view in the YZ plane for the cathode geometry for a multi-beam electron gun.
Figure 3B:
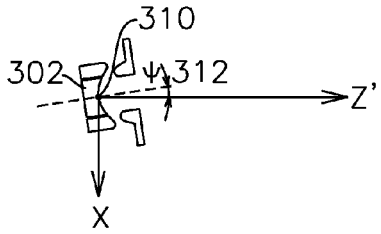
FIG. 3B shows a cross section view in the XZ plane for the cathode geometry for a multi-beam electron gun.

FIG. 3A shows a 2D projection of two electron beams and related structures for a multiple beam electron gun according to the invention. Each cathode and related structure is positioned and oriented according to a set of parameters which are identified for a particular cathode construction, and the others use this same construction. In FIG. 3A, the cathode structure of interest includes circularly symmetric cathode 303 which is surrounded by annular focus electrode 302 and anode 314. The cathode 303, focus electrode 302, and anode 314 are symmetric about a local cathode axis 304, and a central cathode point 310 is defined by the intersection of the local cathode axis 304 with the emitting surface of the cathode 303. From geometrical construction, a unique plane is defined by a line and a point external to the line. In the present device, a reference cathode plane is defined by the Z axis and the central cathode point 310, and the local cathode axis is set to an angle Θ 306 which is established by the angle of the magnetic flux 326 generated by solenoidal coil 322 at the point where the magnetic flux passes through cathode central point 310. The first parametric angle Θ 306 (also known as a cathode divergence angle) thereby relies on the design of the magnetic structure including solenoidal coil 322, pole pieces 320 and 324, which govern the nature of the divergence of the magnetic field at the point of intersection with cathode central point 310. A second parametric angle ψ 312 (also known as a cathode azimuthal angle) is shown in the XZ plane view of FIG. 3B. The introduction of angle ψ 312 provides an out-of-center launch of the electron beam into the magnetic field, and a numerical solution of preferred angle ψ 312 results in a cancellation or minimization of the beam spiraling in the RF axial extent. The present invention utilizes the existing magnetic field for the particular design, and varies the attitude of the local cathode axis divergence angle 306 and azimuthal angle 312 in combination with a beam spiraling metric which indicates when substantially parallel electron beams are generated. When the particular local cathode axis attitude is determined, the same value is used for the other cathode structures such as 316 which has a cathode central point 318 located in the same XY plane. For clarity in description of angle 312 of FIG. 3B, the Z axis of FIG. 3A is translated to parallel line Z' so it passes through cathode central point 310.

Figure 4:
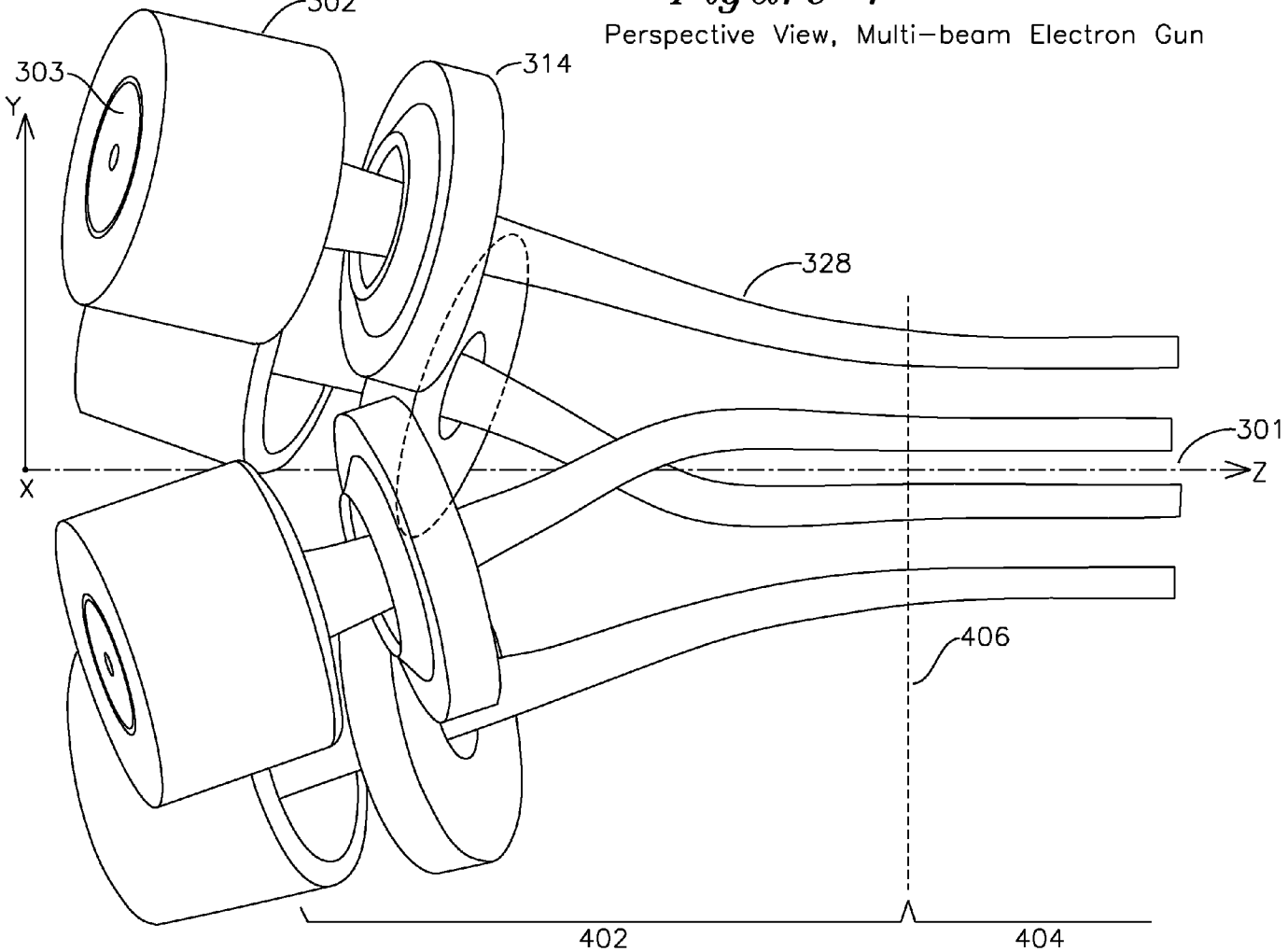
FIG. 4 is a perspective view in the YZ plane of a multi-beam electron gun showing resultant electron beam trajectories.

FIG. 4 shows one embodiment of the invention for N=4 electron beams in a perspective view in the YZ plane. A particular cathode 303, focus electrode 302 and anode 314 generate electron beam 328, which exhibits minor spiraling in the magnetic field divergence extent 402, thereby forming electron beams which are substantially parallel to Z axis 301 in RF circuit axial extent 404. The improved multi-beam gun thereby achieves beam-to-axis radial spacing and beam to beam spacing which is substantially less than the cathode center point to axis and cathode center point to cathode center point separation distance, thereby providing a significant reduction in the size of the required RF circuits in RF circuit extent 404.

Figure 5:
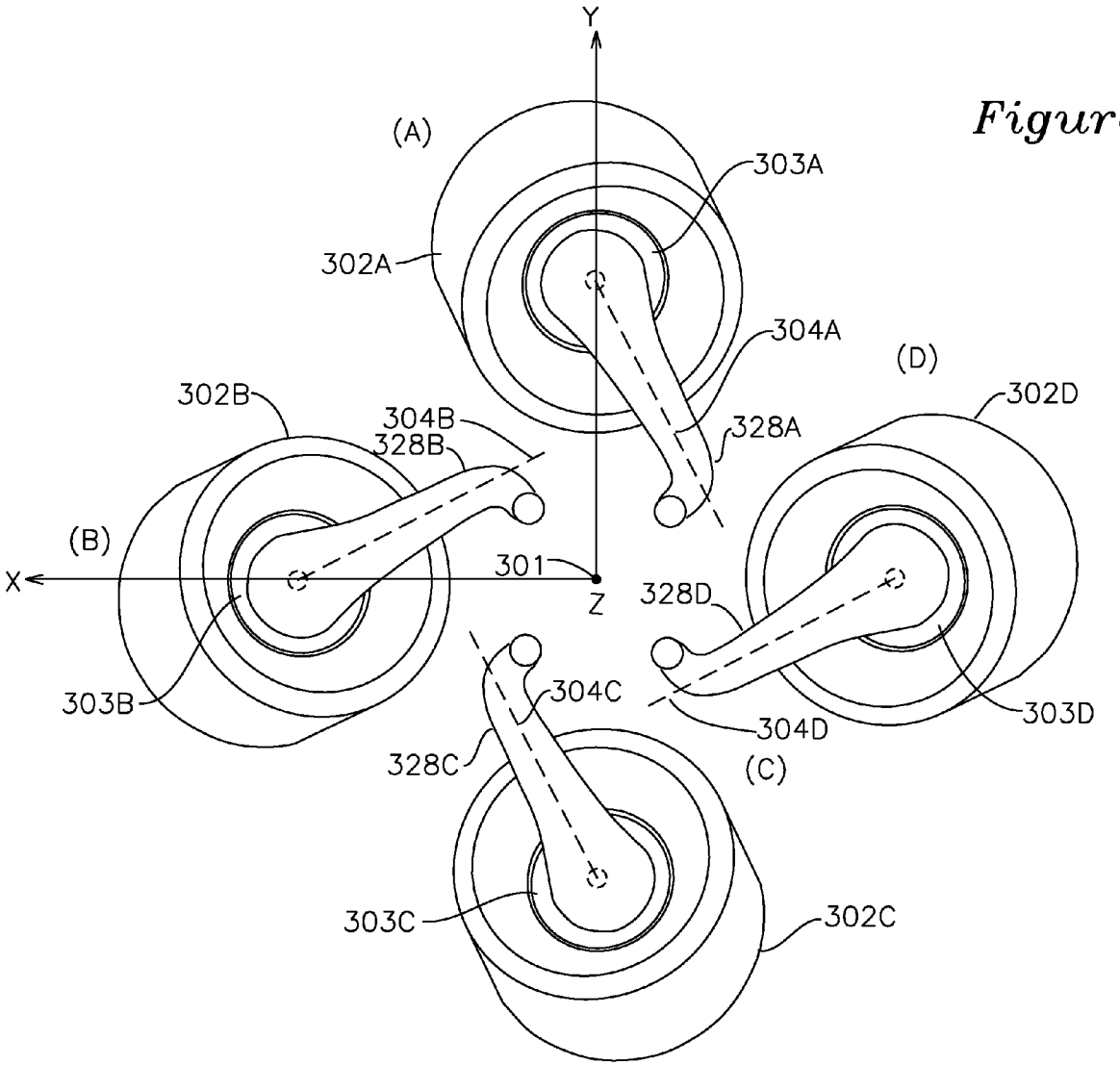
FIG. 5 is a perspective view in the XY plane of a multi-beam electron gun and resultant electron beams over a converging magnetic field region.

FIG. 5 shows a perspective view of the cathode structures in the XY plane and as viewed from section line 406 of FIG. 4, with suffix A, B, C, and D added for each associated electron gun structure. The example discussion for specific electron gun A may be applied to the other structures B through D in the symmetric structure shown. FIG. 5 shows, for a gun assembly such as 302, 303, 314 of FIG. 4, electron beams 328A emitted from the surface of thermionic cathode 303A and the compressed magnetic field causes the electrons to be accelerated in the magnetic field convergence region 402 between the cathode 303A and anode (314 of FIG. 4). A converging axial magnetic field exists in region 402 generated by solenoid 322 shown in FIG. 3A and shaped by pole piece 320. The electric fields in region 402 are shaped by focus electrode 302A and anode 314A (removed from FIG. 5 for clarity, but shown in FIGS. 3A, 3B, and 4. The local cathode axis 304A of each cathode emitter 303A forms an angle with the central axis 301 of the device in the 2D projection as shown in FIG. 3A. Each local cathode axis 328A does not intersect the centerline of the device 301, but they are rotated by angle ψ 312 in the azimuthal direction about centerline 301. Electrons emitted from each cathode 303 are compressed about local cathode axis 304A and converge generally toward device axis 301. The magnitude of the compression about the device axis 301 is determined by the magnetic field values according to Bush's Theorem. When each electron beam 328A, 328B, 328C, 328D enters the RF circuit extent defined by the region between pole pieces 320 and 324 of FIG. 3A, the magnetic field is constant in value and the electron beams 328A, 328B, 328C, 328D propagate parallel to device axis 301 but rotated about the axis 301 with respect to initial cathode central points 310A, 310B, 310C, 310D, respectively, where the rotation of the beams about the axis occurs in divergence region 402, as shown in FIGS. 4 and 5.

Figure 6:
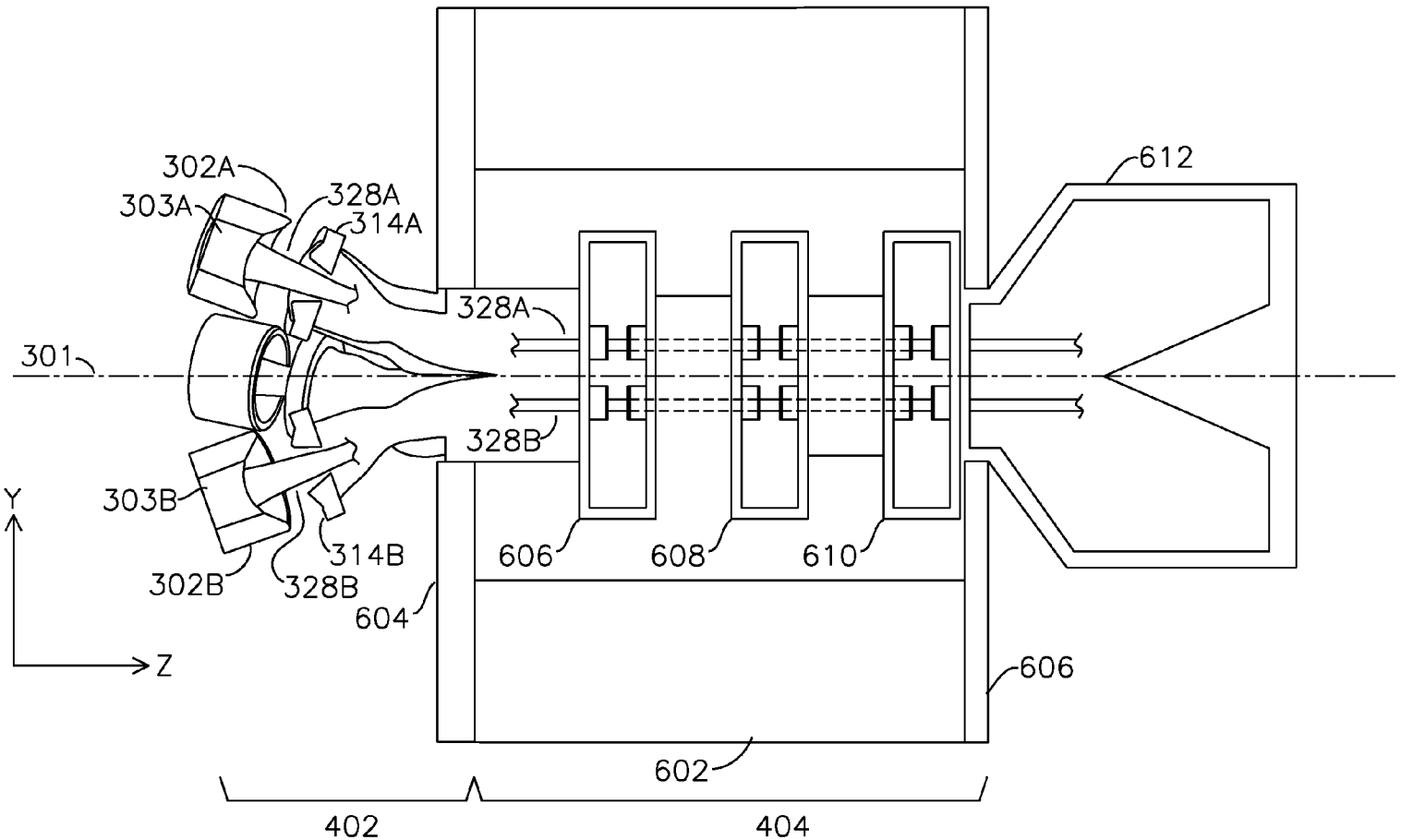
FIG. 6 shows a cross section view of a multi-beam klystron incorporating the electron gun of FIGS. 3A, 3B, 4, and 5.

FIG. 6 shows a section view of the electron beams for a 4-beam multiple beam electron gun including the RF circuit for a klystron, for which only the A suffix guns are described for clarity. Electrons are emitted from cathode 303A and focused by focus electrode 314A. The local axis of each cathode is positioned with the divergence angle 306 described for FIG. 3A and azimuthally angle 312 described in FIG. 3B such that each electron beam is emitted at an angle with respect to device axis 301 and converge about their local cathode axis 304A and the device axis 301.

As described earlier, electrons 308 emitted in a magnetic field 304 incur canonical angular momentum depending on the magnitude of the magnetic field and the angular velocity of the electrons. Changes in the magnetic field magnitude such as compression of the field into the RF axial extent 404 requires a corresponding change in the angular velocity so that the total canonical angular momentum is conserved. The angles of emission of the electrons at the cathode are determined such that the electron angular velocity is zero when the magnetic field achieves its value in the circuit region of the device. This results in electron beams 328 that propagate parallel to the device axis 301 in the RF circuit axial extent region 404 of the device after experiencing a rotation about the Z axis in the XY plane from cathode center to associated electron beam center associated with the second parametric angle ψ and as seen in FIG. 5. The first parametric angle Θ 306 is independent of the direction of the magnetic field, however the second parametric angle ψ maintains switches sign to the opposite side of the cathode reference plane when the direction of the magnetic field is reversed. Additionally, the reduction in electron beam distance from the Z axis may be expressed as the ratio of a first radial distance from Z axis to cathode center point to Z axis to a second radial distance of the associated electron beam center in the RF axial extent, with the ratio of first radial distance to second radial distance being on the order of 2 or more.

FIG. 6 shows a cross section view of the invention incorporated in an RF device such as a klystron. As with the previous convention, each repeated structure is described with an A suffix, with the other structures being circularly rotated by 360/N degrees. Cathode 303A arrayed around device axis 301 emits electron beams 328A into an acceleration region between cathode 303A and anode 314A where electric fields shaped by focus electrodes 302A and anode 314A and magnetic field formed by solenoid 602 and pole pieces 604 and 606 guide the electron paths through the device. The converging magnetic field in the acceleration region and convergent region 402 causes the beam 328A to converge toward device axis 301 while rotating about the axis 301 until reaching constant magnetic field region 404 where the electron beam 328A propagates parallel to device axis 301 and the other electron beams 328B, 328C, etc. The beam 328A is transported through one or more buncher cavities 606 and 608 where the electron velocities are modulated such that electron energy can be converted to RF energy in output cavity 610. The electrons continue into the electron beam collector 612 where they are collected on the tapered inner walls.

Figure 7:
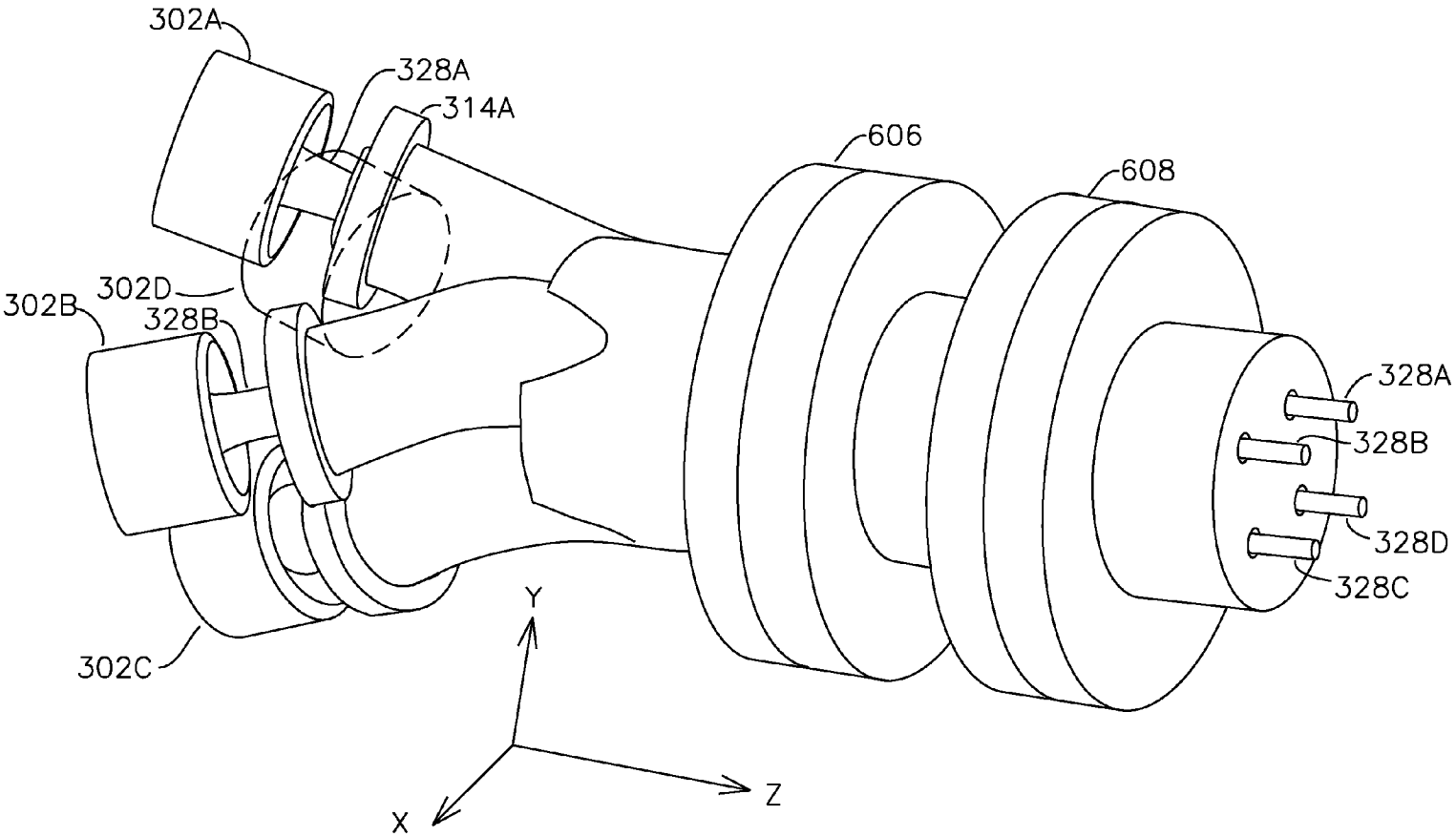
FIG. 7 shows a perspective view of the multi-beam device of FIG. 6.

FIG. 7 (N=4) shows a perspective view showing different structures present in the device of FIG. 6. A first RF resonator 606 and second RF resonator 608 are shown with focus electrode 302A (which is concealing inner cathode 303A), anode 314A and electron beam 314A.

The illustrations of the present description are provided for understanding of the invention, and are not intended to limit the scope of the invention to only the examples shown. It is clear that any number of N electron gun assemblies may be used, including the off-axis case for N=1, and the cathodes may be symmetric about the local cathode axis, or the cathode may be asymmetrically formed about the local cathode axis. Additional configurations are possible, including multiple concentric rings of cathodes, each concentric ring having its own value of M cathodes arranged with a separation of 360/M degrees with respect to the central axis. For each configuration, the individual cathodes may be of any diameter and have any initial radial separation between the associated central cathode point and central axis, and the electron beams which are formed in the RF circuit axial extent may have any radial separation which is smaller than (or larger than) the initial radial cathode separation. The electron beams may be used in the RF circuit axial extent in combination with resonant structures for low frequency RF devices, or in combination with traveling wave structures for high frequency RF devices.

In one example according to the invention and shown in the drawing FIGS. 4 through 7, a compressed beam electron gun has n=4 electron beams which are parallel to the z axis and separated from the z-axis by 15 mm through the RF circuit axial extent which has a uniform magnetic field of 900 gauss. The electron gun of the present example operates at 1.3 Ghz and each cathode has a diameter of 28 mm, a cathode center point distance from central axis of 60 mm, and a cathode radius of curvature of 30.3 mm. The formation of parallel electron beams through the RF circuit axial extent results from the selection of first parameter magnetic field divergence angle (measured at the cathode center point) of 23 degrees and with a magnetic field strength at the cathode center point of 225 gauss, and with the second parametric angle (cathode azimuthal angle) of 6 degrees. This particular example design provides an electron beam area compression ratio of 16:1, such that the beams in the circuit extent are reduced in radial extent by a factor of 4. The parameters provided may be varied ±20% or more from the values shown for this example, and it is also possible to extend the number of cathodes for this design to n=8 cathodes using the geometry described for the present example, with only a change to the focus electrode geometry for each cathode, with the focus electrode for each cathode designed according to well known prior art methods. In this manner, a compressed beam electron gun having a beam area compression ratio of 16 or more can be realized which has parallel and uniform cross section profile electron beams through the RF circuit region (uniform magnetic field axial extent) of the device. The example provided is for understanding the operation and advantages of the device, and is not intended to limit the device or method for designing such a device to the examples shown.

The present invention has particular advantages for high frequency and high power devices. In one example embodiment, the electron gun is used with a klystron device having N=4 electron guns, where the each cathode center point is 6 cm from the Z axis, the cathode and focus electrode diameter is on the order of 6 cm, and the associated electron beam is on the order of 2 cm from the Z axis. In this example embodiment, the multiple beam electron gun assembly is used with klystron RF structures, and is able to provide a peak pulsed output power of 10 MW at 1.3 Ghz. The scope of the invention is limited only by the claims as set forth below.

We claim:

1. A multiple beam electron gun having:

a magnetic field generator providing a substantially uniform magnetic field over an RF circuit extent of a Z axis, said magnetic field diverging from said Z axis through an electron gun extent outside said RF circuit extent;

a plurality of N electron guns arranged about said central Z axis, each said electron gun having:

a cathode having an electron emission surface, said cathode having a local cathode axis and a center cathode point located at the intersection of said local cathode axis and said electron emission surface;

a separate focus electrode associated with each said cathode;

a separate single anode associated with each said cathode which is circularly symmetric about said local cathode axis;

said cathode oriented with a cathode divergence angle formed by the angle of perpendicular projection of said local cathode axis onto a cathode reference plane formed by said Z axis and said center cathode point, whereby said cathode divergence angle is substantially equal to a magnetic flux angle in a plane containing said center cathode point and said Z axis;

said cathode oriented with a cathode azimuthal angle formed by the angle between said local cathode axis and said cathode reference plane;

where said cathode azimuthal angle is selected such that said each said electron gun generates an electron beam which is substantially parallel to said Z axis over said RF circuit extent and where the distance from said Z axis to said cathode center point is greater than the distance from said Z axis to the center of an associated electron beam over said RF circuit axial extent;

whereby each said electron beam travels in a separate beam tunnel.

2. The electron gun of claim 1 where the difference in angle between said cathode azimuthal angle and the magnetic field divergence at said cathode center point is less than 10 degrees.

3. The electron gun of claim 1 where said cathode is circularly symmetric about said local cathode axis.

4. The electron gun of claim 1 where each said electron gun has an anode and focus electrode for reducing the diameter of an associated electron beam to less than the diameter of an associated said cathode.

5. The electron gun of claim 1 where said RF circuit axial extent includes at least one resonant cavity for the introduction of RF energy and one resonant cavity for the removal of RF energy.

6. The electron gun of claim 1 where said RF circuit axial extent includes at least one resonant cavity which supports only a fundamental mode of a frequency that is modulated onto said electron beam.

7. The electron gun of claim 1 where a first line formed by projection of the line from said cathode center point to said Z axis onto an XY plane perpendicular to said Z axis and a second line formed by the projection of the center of said electron beam in said RF circuit axial extent to said Z axis onto said XY plane forms an angle which is greater than zero.

8. The electron gun of claim 1 where the cathode divergence angle for one particular cathode of said electron gun is substantially the same as the cathode divergence angle for at least one other cathode of said electron gun.

9. The electron gun of claim 1 where the cathode azimuthal angle for one particular cathode of said electron gun is substantially the same as the azimuthal angle for at least one other cathode of said electron gun.

10. The electron gun of claim 1 where said beam tunnels include gaps forming resonant chambers in said RF circuit axial extent.

11. The electron gun of claim 1 where said electron beams are coupled to a plurality of resonant chambers which support only fundamental mode RF, said resonant chambers located in said RF circuit axial extent.

12. A process for selection of a cathode first parametric angle and a cathode second parametric angle in a multi-beam electron gun generating a plurality of distinct electron beams, the multi-beam electron gun having a magnetic field generator located about a Z axis and generating a substantially uniform magnetic field over an RF circuit axial extent, said magnetic field diverging outside said RF circuit axial extent and also diverging over a cathode extent, the multi-beam electron gun having a plurality N of electron guns located about said Z axis, each said electron gun having a cathode with an emission surface and a local cathode axis, each said cathode having a separate focus electrode which is circularly symmetric about each said cathode, each said cathode also having a separate anode, each said electron gun generating a separate electron beam traveling in a separate beam tunnel, said cathode having a center point at the intersection of said emission surface and said local cathode axis, said first parametric angle formed by the angle between said Z axis and the line formed by the projection of said cathode axis onto a cathode reference plane formed by said Z axis and said cathode center point, said second parametric angle formed by the angle between said cathode reference plane and said local cathode axis, said first parametric angle and said second parametric angle controlling the spiraling of a resultant electron beam, said spiraling having an associated spiraling metric;

said process having:

a first step of selecting a plurality of first parametric angles which is within five degrees of the magnetic field divergence at said cathode center point;

a second step of selecting a plurality of said second parametric angles and evaluating each said combination of said first parametric angle and said second parametric angle for said spiraling metric;

a third step of selecting a minimum spiraling metric and associated said first parametric angle and said second parametric angle;

a fourth step of using the first parametric angle and second parametric angle associated with said minimum spiraling metric for each said cathode of said N electron guns.

13. The method of claim 12 where said third step includes selecting said first parametric angle and said second parametric angle to introduce an azimuthal electron velocity in said diverging magnetic field region which is substantially zero over said RF circuit axial extent.

14. The method of claim 12 where said fourth step is the performance of said first through third steps for each remaining cathode to determine said first parametric angle and said second parametric angle for each said remaining cathode.

15. A multiple beam electron gun having:

a magnetic field generator providing a substantially uniform magnetic field over an RF circuit extent of a Z axis, said magnetic field diverging from said Z axis over a cathode extent outside said RF circuit extent;

a plurality of N electron guns arranged about said central Z axis, each said electron gun having:

a cathode having an electron emission surface, said cathode having a local cathode axis and a center cathode point located at the intersection of said local cathode axis and said electron emission surface;

a separate focus electrode for each said cathode which has an inner diameter which is equal to or greater than a cathode diameter;

a separate anode for each cathode, each said separate anode having an aperture for the passage of an associated electron beam;

said cathode having a cathode divergence angle formed by the angle formed by perpendicular projection of said local cathode axis onto a cathode reference plane formed by said Z axis and said center cathode point;

said cathode having a cathode azimuthal angle formed by the angle between said local cathode axis and said cathode reference plane;

where each said cathode local cathode axis is oriented to generate electron beams which are substantially parallel to each other and to said Z axis over said RF circuit axial extent;

and each said electron beam travels in a separate beam tunnel through said RF circuit axial extent.

16. The multiple beam electron gun of claim 15 where each said center cathode point is located on a plane perpendicular to said Z axis.

17. The multiple beam electron gun of claim 15 where each said cathode central point is equally spaced from an adjacent cathode central point by 360/N degrees.

18. The multiple beam electron gun of claim 15 where said RF circuit axial extent includes a plurality of resonant cavities coupled to said electron beams.

19. The multiple beam electron gun of claim 18 where said resonant cavities support only a fundamental mode frequency which is coupled either to or from said electron beams.

* * * * *